United States Patent [19]

Vreeland

[11] 4,440,809

[45] Apr. 3, 1984

[54] METHOD AND APPARATUS FOR RECIRCULATING COATING LIQUID IN A PAPER COATING APPARATUS

[75] Inventor: William C. Vreeland, Wisconsin Rapids, Wis.

[73] Assignee: Consolidated Papers, Inc., Wisconsin Rapids, Wis.

[21] Appl. No.: 458,472

[22] Filed: Jan. 17, 1983

[51] Int. Cl.[3] ..... B05C 3/18

[52] U.S. Cl. ..... 427/356; 118/410; 118/413

[58] Field of Search ..... 118/407, 410, 413, 259; 427/356, 358

[56] References Cited

U.S. PATENT DOCUMENTS

| | | | |
|---|---|---|---|
| 3,097,968 | 7/1963 | Schaefer | 118/259 |
| 3,252,443 | 5/1966 | Growdon et al. | 118/407 |
| 3,511,693 | 5/1970 | Davidson | 118/413 X |
| 4,250,211 | 2/1981 | Damrau et al. | 118/413 X |

*Primary Examiner*—John P. McIntosh

*Attorney, Agent, or Firm*—Gary, Juettner & Pyle

[57] ABSTRACT

Apparatus for applying a coating liquid to a moving web of paper carried through an application zone is characterized by a system at each side end of the zone for recirculating coating liquid thereat. In use of such an applicator coating liquid at the side ends of the zone tends to stagnate, and the recirculating system eliminates coating buildup in the side ends.

18 Claims, 2 Drawing Figures

METHOD AND APPARATUS FOR RECIRCULATING COATING LIQUID IN A PAPER COATING APPARATUS

BACKGROUND OF THE INVENTION

The present invention relates to a method and apparatus for coating a moving web of paper carried through an application zone, and in particular to a coating method and apparatus of the trailing blade type wherein recirculation is provided for coating liquid in stagnant areas at side ends of a coating liquid application zone.

Conventional coaters of the trailing blade type includes means for applying coating material to a paper web that is usually supported and carried by a resilient backing roll, together with a flexible doctor blade located some distance from and on the trailing side of the applicator, which serves to level the applied coating. In general, an excess of coating material is applied to the web, and the blade then meters or removes the excess while uniformly spreading the coating onto the web surface.

In recent years, it has become desirable to produce printed papers having a minimal amount of coating, i.e., on the order of about two or three pounds of coating per ream of paper. To achieve low coat weights on conventional trailing blade equipment, it is necessary to increase the pressure of the trailing blade against the web, which results in a high rate of wear on the blade. High blade pressure also increases the possibility of web breakage and streaking caused by foreign particles being caught between the blade and web.

Many conventional coaters inherently employ a relatively long dwell or soak time, which is the time interval between the initial application and final blading of the coating. As a result, the water portion of the coating composition, as well as the water soluble or dispersible materials contained therein, migrate into the moving web at a more rapid rate than the pigment and eventually cause an undesirable imbalance in the coating constituents and their rheological properties. Long soak periods are also incompatible with the application of successive wet coats without intervening drying because the successive coats tend to migrate into and contaminate the previous coat.

In overcoming the disadvantages of the prior art there has been developed an improved applicator, generally known as a short dwell time applicator, as disclosed in Damrau et al U.S. Pat. No. 4,250,211, assigned to the assignee of the present invention. That applicator comprises a tapered chamber leading from a supply of coating material to a narrow outlet slot and a doctor blade extending from the trailing side of the slot in contact with the web. The leading edge of the chamber adjacent the slot is closely spaced from the supported web so as to form, in conjunction with the pressurized fluid flowing from the slot, a gap with the web in which a liquid seal is established, and the side ends of the slot are substantially sealed to the web to allow the establishment of the positive liquid pressure of the chamber in a zone of application.

The coater forms an enclosed application zone with the web to apply a continuous narrow strip or band of pressurized coating material thereon, which enables application of lower coat weights than have heretofore been feasible. However, because coating liquid is introduced through the slot into the application zone along the entire length of the zone, it is also directed against edge seals at side ends of the zone which seal the zone and enable uncoated margins to be maintained on the edges of the web, increasing the tendency for some of the coating liquid to force its way past the edge seals and cause coating material stickers on the web edges. In order to block direct impingement of coating liquid against the edge seals and reduce leakage therepast, deckles have recently been provided across the slot beneath the seals. However, while such deckles have proven effective in controlling leakage of coating liquid past the edge seals, they create stagnant areas of coating liquid at side ends of the application zone, resulting in an accumulation of stagnate coating thereat and a need to frequently disassemble the applicator for cleaning.

OBJECT OF THE INVENTION

The primary object of the present invention is to provide a system for recirculating coating liquid within otherwise stagnant areas at side ends of an application zone of a short dwell time applicator.

SUMMARY OF THE INVENTION

In accordance with the present invention, there is provided an improved applicator for applying coating liquid to a moving web of paper carried through an application zone. The applicator is of the type comprising a body portion defining a chamber therein having an elongate opening thereto extending substantially transversely across and against the web; and an orifice plate at a front side of said chamber opening extending substantially transversely across and toward but spaced from the web to define a gap therewith. Said applicator also includes means for sealing opposite side ends between said doctor blade and orifice plate, said means for sealing, doctor blade and orifice plate defining said application zone, as well as means for introducing coating liquid under pressure through said chamber opening and into said application zone for application onto the web. As taught by the invention, the improvement comprises means at each side end of said application zone for withdrawing coating liquid from an area of said zone below said means for sealing and said orifice plate gap, whereby stagnant areas of coating liquid do not form at said side ends and stagnate coating does not build up in said zone thereat.

The invention also contemplates an improved method of applying coating liquid to a moving web of paper, which comprises the steps of applying coating liquid to one surface of a moving web of paper through a limited application zone having spaced front and rear edges and laterally spaced side edges; forming and maintaining a reservoir of coating liquid on the web in the application zone between the front, rear and side edges thereof; and doctoring the coating liquid on the web at the rear edge of the application zone. According to the invention, the improvement includes the further step of withdrawing coating liquid from the application zone at each side end thereof from an area below the front edge and side edge, so that stagnant areas of coating liquid do not form at the side ends of the zone and stagnate coating does not build up in the zone thereat.

The foregoing and other objects, advantages and features of the invention will become apparent upon a consideration of the following detailed description, when taken in conjunction with the accompanying drawings.

DETAILED DESCRIPTION

Figure 1:
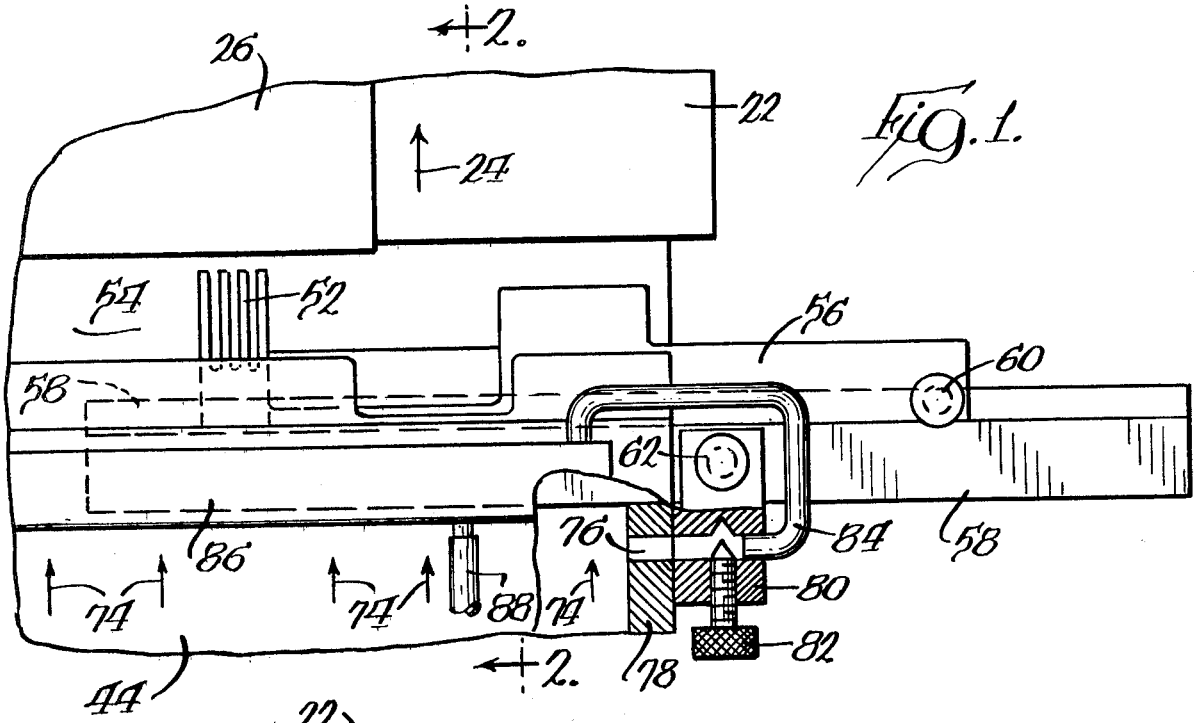
FIG. 1 is a front elevation view of one side end of a paper coater, illustrating in accordance with the teachings of the invention a recirculation system for removing stagnant coating liquid from a side end of a coating liquid application zone.
Figure 2:
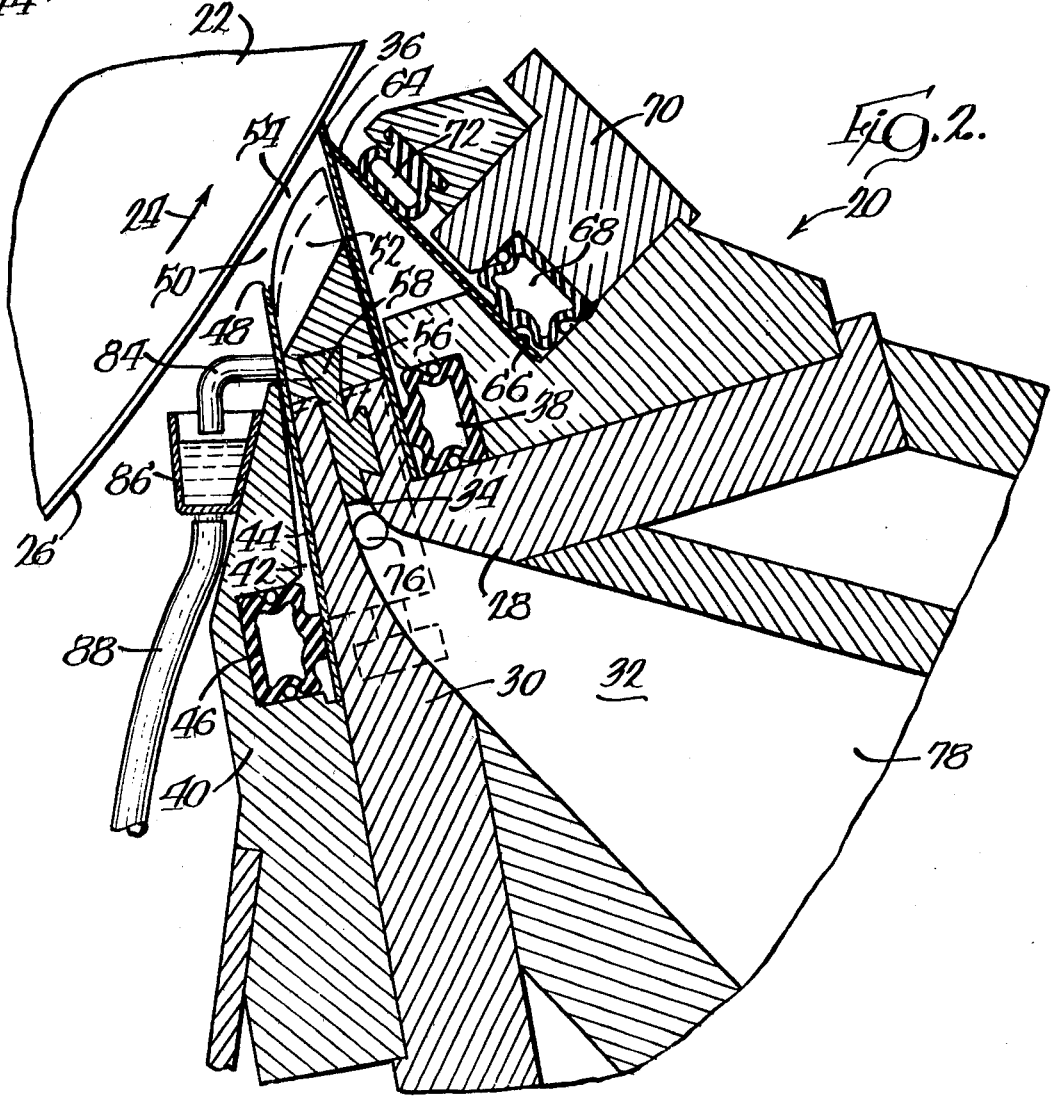
FIG. 2 is a cross sectional side elevation view taken substantially along the lines 2—2 of FIG. 1, illustrating further details of the applicator and of the recirculation system of the invention.

Referring to the drawings, there is shown an applicator or paper coating machine embodying the teachings of the present invention. The applicator comprises a main beam, indicated generally at 20, extending parallel to and coextensively with a movable support or backing roll 22 which rotates in the direction shown by an arrow 24 and supports a web of paper 26 during its travel through the applicator. The beam has walls 28 and 30 forming a chamber 32 therebetween for reception of liquid coating material under pressure from a source of material (not shown), and the front and rear walls 30 and 28 converge upwardly toward one another and define a metering slot 34 which extends upwardly adjacent to, facing and across the web supporting surface of the roll 22. Although not shown, the front wall is pivotally mounted relative to the rear wall to permit the chamber 32 to be opened for cleaning and also to adjust the width of the metering slot 34.

A flexible doctor or coater blade 36 is held against a rearward surface of the wall 28 by a pneumatic tube 38 which is expandable by the introduction of fluid under pressure therein to press against the doctor blade. The doctor blade extends beyond the metering slot 34 into engagement with the web of paper supported on the roll and serves to meter and level the coating applied on the surface of the web. A mounting plate 40 defines with the front wall 30 a slot 42 extending substantially transversely across and opening toward the web, and an orifice plate 44 is received in the slot and extends substantially transversely across the web. The orifice plate is releasably held in position in the slot by a pneumatic tube 46 and has an upper free edge 48 which is juxtaposed to but spaced slightly from the web, such that a space or gap 50 between the edge and the web is relatively small and less than one inch.

At the two ends of the coater, the spaces between the coater blade 36 and the orifice plate 44 are sealed off by flexible edge seals 52 which sealingly engage the upper edges of the walls 28 and 30, the blade and the orifice plate, and closely approach the roll supported web 26, thereby to define a coating material application zone 54 downstream from the chamber 32 and metering slot 34. Each edge seal is carried at an end of an elongate body portion 56 extending transversely out of the side end of the application zone, and to support the edge seal in position the body is dovetailed with an elongate deckle 58, the deckle in turn being dovetailed with the wall 28 within the metering slot and extending transversely inwardly of the metering slot and application zone to a point slightly beyond the edge seal 52. The edge seal and deckle are independently adjustable laterally of the application zone, and to that end a pair of thumb screws 60 and 62 are providing for securing the edge seal and deckle in place once adjusted.

To urge a tip of the doctor blade 36 against the web for metering and leveling the coating thereon, a loading device for the doctor blade includes a flexible loading blade 64 seated at its lower end against a wall 66 of the main beam 20 and held against the wall by an inflatable pneumatic tube 68 extending along and within a loading blade housing 70 mounted on the main beam. To urge the loading blade against the doctor blade to load the same, a second pneumatic tube 72 at an upper end of the housing 70 is inflatable to engage the loading blade with a selected force determined by the pressure of fluid within the tube. While for the purpose of simplifying the drawing the loading blade housing is illustrated as being mounted in fixed angular relationship to the main beam, it is to be understood that, although not shown, a suitable adjusting means means is provided to vary the angular relationship of the housing with respect to the main beam, and therefore the angle of the loading blade with respect to the doctor blade.

In operation of the applicator, coating liquid is supplied under sufficient pressure and in sufficient quantity to completely fill the chamber 32, the metering slot 34 and the application zone 54 defined by the doctor blade 36, the orifice plate 44 and the edge seals 52, to cause a continuous, copious flow of coating material reversely of the direction of web travel through the narrow strip or gap 50 defined between the upper end 48 of the orifice plate and the web. This forms a liquid seal between the edge and the web and causes coating liquid to be applied to the web in a very narrow transverse band under a constant positive pressure. The copious excess of coating liquid that flows through the orifice gap forms a non-abrasive liquid seal with the web at the forward edge of the coating application zone; causes the coating liquid in the application zone to be maintained under pressure and to be applied to the web under pressure; seals off the forward edge of the application zone against entry of air and foreign matter; strips air from the high speed web and prevents such air from causing streaks or skips in the coating on the web; and causes the doctor blade to doctor the coating liquid while the liquid is held under pressure.

The applicator thus far described, except for the specific structure of the doctor blade loading mechanism, the edge seals and deckles and the mounting of the orifice plate, is disclosed in detail in U.S. Pat. Ser. No. 4,250,211, assigned to the assignee of the present invention, the teachings of which are specifically incorporated herein by reference. For a more specific description of the applicator, reference is made to said patent.

The metering slot 34 extends transversely across the application zone 54 and, as shown in FIG. 1, introduces coating liquid into the zone along the entire length thereof, as indicated by arrows 74. Absent the deckles 58, coating liquid exiting the metering slot would flow directly against the edge seals 52 and tend to force its way past the seals, destroying the integrity of uncoated margins on the edges of the paper web and causing stickers of coating to be deposited thereon. Consequently, the deckles are provided to block off side ends of the metering slot to prevent direct impingement of coating liquid against the edge seals.

In use of the edge seal assemblies and deckles, a disadvantage found to exist is that since the flow of coating material through the metering slot at the side ends of the application zone is blocked, stagnant areas of coating liquid are created in the side ends of the slot and zone, with the result that stagnate coating buildup occurs in the side ends, necessitating cleaning of the applicator.

To overcome the foregoing disadvantage and prevent coating buildup in the side ends of the metering slot and application zone, the invention contemplates withdrawal and recirculation of coating liquid in the side ends. To that end, at each side end of the applicator an exit port or opening 76 is formed through a side wall 78 of the applicator in communication with the slot and zone thereat. The exit port is coupled with a passage through a valve housing 80 having a valve 82, and thence through a conduit 84 with a trough 86 carried on an upper end of the mounting plate 40. The trough primarily receives coating liquid flowing through the gap 50 and forming the liquid seal, from whence the liquid flows through drain hoses 88 to the main supply thereof for recirculation. However, because the coating liquid in the metering slot and application zone is maintained under pressure for pressurized application onto the web, coating liquid at the side end of the zone and slot also flows into the trough through the outlet port 76, the valve housing 80 and the conduit 84 for collection and recirculation. Thus, coating liquid at the side ends of the application zone and metering slot is constantly withdrawn and recirculated to eliminate stagnant areas of coating liquid and stagnate coating buildup at the side ends, and therefore the necessity to periodically clean the applicator.

As is apparent, the valve 82 is adjustable to control the flow rate of coating liquid through the valve housing, and therefore the rate of recirculation of coating liquid, although if desired any other suitable means may be provided to control the rate of recirculation, such for example as a pinching clamp for the conduit to control the flow area therethrough.

While one embodiment of the invention has been described in detail, various modifications and other embodiments thereof may be devised by one skilled in the art without departing from the spirit and scope of the invention, as defined in the appended claims.

What is claimed is:

1. In an improved applicator for applying coating liquid to a moving web of paper carried through an application zone, wherein the applicator is of the type comprising a body portion defining a chamber therein having an elongate opening thereto extending substantially transversely across the web; a doctor blade extending from a rear side of said chamber opening substantially transversely across and against the web; an orifice plate at a front side of said chamber opening extending substantially transversely across and toward but spaced from the web to define a gap therewith; means for sealing opposite side ends between said doctor blade and orifice plate, said means for sealing, doctor blade and orifice plate defining said application zone therebetween; and means for introducing coating liquid through said chamber opening and into said application zone for application onto the web, the improvement comprising means at each side end of said opening and application zone for withdrawing coating liquid from an area of said opening and application zone below said means for sealing and said orifice plate gap, whereby stagnant areas of coating liquid do not form at said side ends of said opening and zone and stagnate coating does not build up thereat.

2. In an improved applicator as in claim 1, wherein said means for withdrawing conveys the withdrawn coating liquid to a main supply thereof for recirculation.

3. In an improved applicator as in claim 1, wherein said means for withdrawing includes means for controlling the rate at which coating liquid is withdrawn.

4. In an improved applicator as in claim 1, wherein said means for withdrawing includes an outlet port formed through a side wall of said applicator into said opening and application zone side end.

5. In an improved applicator as in claim 4, wherein said means for withdrawing further includes a conduit connected with said outlet port for conveying withdrawn coating liquid to a main supply thereof for recirculation.

6. In an improved applicator as in claim 1, wherein said means for introducing coating liquid introduces a copious excess of coating liquid under pressure through said opening into said application zone to substantially continuously and completely fill said zone and flow coating liquid through said gap to form a liquid seal in said gap for pressurized application of coating liquid on the web, and said means for withdrawing includes an outlet port formed through a side wall of said applicator into said opening and application zone side end for a pressurized flow therethrough of coating liquid from said side end.

7. In an improved applicator as in claim 6, including a conduit connected with said outlet port for conveying a withdrawn coating liquid to a main supply thereof for recirculation.

8. In an improved applicator as in claim 7, including means coupled with at least one of said outlet port and conduit for controlling the flow rate of coating liquid therethrough.

9. In an improved applicator as in claim 7, wherein said applicator includes a trough beneath and extending substantially along said orifice plate gap for receiving coating liquid flowing through said gap for return to a main supply thereof and an upper end of said trough is vertically above said outlet port, and said conduit extends between said outlet port and said upper end of said trough, the pressure of liquid in said side end of said opening and application zone providing a flow of liquid from said side end through said outlet port and conduit to said trough.

10. In an improved applicator as in claim 6, wherein said means for sealing at each side end of said doctor blade and orifice plate comprises an edge dam means assembly extending partially into the side end of said opening and application zone thereat, and said withdrawing means withdraws coating liquid from an area beneath said edge dam assembly.

11. In an improved method of applying coating liquid to a moving web of paper, comprising the steps of applying coating liquid to one surface of a moving web of paper through a limited application zone having spaced front and rear edges and laterally spaced side edges; forming and maintaining a reservoir of coating liquid on the web in the application zone between the front, rear and side edges thereof; and doctoring the coating liquid on the web at the rear edge of the application zone, the improvement comprising the step of withdrawing coating liquid from the application zone at each side end thereof from an area below the front edge and side edge, so that stagnant areas of coating liquid do not form at the side ends of the zone and stagnate coating does not build up in the zone thereat.

12. In an improved method as in claim 11, including the step of conveying the withdrawn coating liquid to a main supply thereof for recirculation.

13. In an improved method as in claim 11, including the step of controlling the rate of withdrawal of coating liquid from the application zone side end.

14. In an improved method as in claim 11, wherein said withdrawing step includes the step of flowing coating liquid at the application zone side end through an outlet port formed through a side wall of the application zone.

15. In an improved method of applying coating liquid to a moving web of paper, comprising the steps of applying coating liquid under pressure to one surface of a moving web of paper carried through a limited application zone having spaced front and rear edges and laterally spaced side edges; forming and maintaining a reservoir of coating liquid under pressure on the web in the application zone between the front, rear and side edges thereof; doctoring the coating liquid at the rear edge of the zone; maintaining the coating liquid in the application zone under pressure by substantially sealing side edges of the zone and by establishing a liquid seal in a gap defined between the web and a front edge of the application zone which extends substantially across the width of the web; and introducing a copious excess of coating liquid under pressure into the application zone to substantially completely and continuously fill the gap with coating liquid for forming the liquid seal, the improvement comprising the step of withdrawing coating liquid from the application zone at each side end thereof from an area below the front edge and sealed side edge, so that stagnant areas of coating liquid do not form at the side end and stagnate coating does not build up in the zone thereat.

16. In an improved method as in claim 15, wherein said withdrawing step includes the step of flowing pressurized coating liquid at the side end of the application zone through an outlet port formed through a side wall of the zone.

17. An improved method as in claim 16, including the step of conveying the pressurized coating liquid flowing through the outlet port through a conduit to a main supply thereof for recirculation.

18. An improved method as in claim 15, including the step of controlling the rate of withdrawal of coating liquid from the application zone side end.

* * * * *